United States Patent [19]

Anderson

[11] 4,129,768

[45] Dec. 12, 1978

[54] METHOD AND APPARATUS FOR MICROWAVE HEATING OF FLOWABLE MATERIAL

[75] Inventor: Eldon E. Anderson, Mountain View, Calif.

[73] Assignee: Gerling Moore, Inc., Santa Clara, Calif.

[21] Appl. No.: 757,602

[22] Filed: Jan. 7, 1977

[51] Int. Cl.[2] ..... H05B 9/06

[52] U.S. Cl. ..... 219/10.55 A; 219/10.55 M

[58] Field of Search ..... 219/10.55 R, 10.55 A, 219/10.55 M, 339, 10.73, 10.75; 204/159.11, 160.1; 260/710; 426/241

[56] References Cited

U.S. PATENT DOCUMENTS 3,626,838 12/1971 Gorakhpurwalla ..... 219/10.55 B

*Primary Examiner*—J. V. Truhe
*Assistant Examiner*—Bernard Roskoski
*Attorney, Agent, or Firm*—Flehr, Hohbach, Test, Albritton & Herbert

[57] ABSTRACT

A microwave oven is provided with a rotatable microwave transparent tube or drum positioned within the same and at an angle to the horizontal, through which material is introduced at the upper end and which flows in continuous agitation to the lower end while being subjected to microwave fields within said oven. In a preferred embodiment uniform heatingof scrap rubber particles to cause devulcanization is disclosed as an immediate useful application.

17 Claims, 9 Drawing Figures

METHOD AND APPARATUS FOR MICROWAVE HEATING OF FLOWABLE MATERIAL

BACKGROUND OF THE INVENTION

This invention relates to a method and apparatus for the microwave heating of flowable materials, and in particular to the devulcanization of particulate rubber scrap.

More particularly, the present invention provides a system including a method and apparatus for the uniform microwave heatinng of flowable materials to high temperatures in a controlled atmosphere isolated from the environment. The present invention finds particular application in the processing of scrap vulcanized rubber into at least partially devulcanized form by microwave heating. It has been known for some time that such scrap rubber can be subdivided into particulate form and reused after being devulcanized by the application of microwave energy. However, the application of this technique has been limited because of the inability to find a suitable method and apparatus by which the same can be scaled to the processing of significant quantities of such rubber. Rubber is particularly difficult to process in microwave fields since rubber at room temperature is relatively non-conductive but becomes progressively more conductive at elevated temperatures. What this means is that the application of a microwave field to reacted heating to elevated temperatures adequate to cause devulcanization of any particulate or elemental portion of rubber also creates a significantly higher conductivity in that portion which in turn results in a run-away thermal condition in which the particle which has achieved such an elevated temperature absorbs an undue share of the microwave energy present ultimately becoming so overheated that it bursts into flame. Accordingly, attempts to reprocess previously vulcanized rubber by conveyor belt transportation of same through a microwave oven have not been commercially successful. There is, therefore, a need for a new and improved method and apparatus for the devulcanization of rubber scrap which will overcome the foregoing limitations and disadvantages.

In addition to the foregoing there are a number of other microwave heating applications in which it would be desirable to process a flowable material passing through a microwave oven in a continuous process which material it is desired to maintain in a state of isolation from the environment. Heretofore, there has not existed a suitable conveying system for processing such materials.

There is, therefore, a need for a general conveying system by which flowable material may be continuously processed, and heated or reacted in a microwave oven while in an agitated state and in isolation from ambient atmosphere.

SUMMARY OF THE INVENTION AND OBJECTS

It is a general object of the present invention to provide a unique and novel microwave heating apparatus and method which will overcome the above limitations and disadvantages. It is a further object of the invention to provide a microwave heating apparatus and method of the foregoing character in which flowable materials are passed through the apparatus in a continuously agitated and intermixed state so as to achieve an exceptionally high degree of uniformity in the heating or treatment of such material.

It is a further object of the invention to provide microwave heating apparatus and method of the above character in which isolation is achieved between the material being treated and the ambient conditions within the microwave apparatus.

It is a further object of the invention to provide a microwave heating apparatus and method of the above character in which the atmosphere in which the material is being treated can be controlled and isolated from ambient.

It is a further object of the invention to provide a method and apparatus of the above character which is particularly adapted to the treatment of rubber scrap which has been reduced to flowable particulate form.

It is a further object of the invention to provide a method and apparatus of the above character which is particularly simple in its essential features but which is uniquely effective in permitting the microwave treatment of particulate materials to heat the same to extremely high temperatures in a controlled atmosphere.

It is another object of the invention to provide a method and apparatus of the above character in which materials which create noxious fumes may be treated by microwave energy while being maintained in an environment which is isolated from atmosphere.

In general the foregoing objects are achieved in the present invention by providing a method and apparatus for heating flowable materials with microwave energy by placing the same in a microwave oven in which is located a microwave transparent tube. The tube is supported for rotation within the cavity at a predetermined angle of inclination to the horizontal and is rotated by a suitable driving mechanism so as to cause the material fed into the upper end of the tube to be progressively shifted downward through the tube to its lower end. The angle of inclination and the speed of rotation are found to be adjustable within appropriate limits for providing a thorough and continuous agitation and mixing of the material as it passes through the tube. More specifically, the angle of inclination for a given range of rotational speeds can be made large enough to prevent build-up of load from filling the tube cross-section, but is made less than that at which the material falls through the tube under gravity without being continuously mixed. In the processing of solid particulate material, such as rubber scrap, it has been found possible to maintain a progressively shifting aggregation of such particles over each particular cross-section such that a fraction of the tube is filled and the particles continuously fall off the upper side of the filled fraction in a continuous mixing action as they pass downwardly through the rotating tube.

In the preferred form of the invention disclosed and claimed herein a circularly cylindrical tube is mounted by suitable support means at least a portion of which together with the rotation drive means is located externally of the microwave cavity. The tube extends completely through the cavity and through suitable endloads for maintaining microwave leakage below acceptable limits. The tube is constructed of a suitable microwave transparent material such as glass or quartz which material is capable of withstanding the temperature of operation desired.

The operation of the present invention is characterized in that the product generally is in one of several subcycles as it passes the downwardly through the product tube and repeats each set of subcycles many times during its passage. Each cycle includes a period of accumulation of particles which are generally carried downwardly at the pitch angle in settled contact with its neighbors with which each particle has the opportunity of establishing thermal equilibrium. As the product rises up the tube wall it eventually goes beyond the angle of repose and is dumped through the atmosphere contained within the tube in a shower of other particle downwardly to the bottom of the tube. During this transition each particle has an opportunity to more individually interreact with the microwave fields than it had when it settled contact with other particles during initial transit. After falling through the height of the tube the particle then begins the next cycle again in settled contact with its neighbors with which it has opportunity to reach thermal equilibrium by such contact. Such exchange of places relative to its previous position occurs a plurality of times during transit through the tube thereby averaging the opportunity for thermal equilibrium among particles and for equalization of a equivalent amount of microwave dosage to each particle. This type of particle heating is found to be extremely effective in maintaining a high degree of uniform product temperature among the particles being treated.

These and other objects and features of the invention will become apparent from the following detailed description thereof when taken with the accompanying drawings of which:

DETAILED DESCRIPTION OF THE PREFERRED EMBODIMENT

Figure 1:
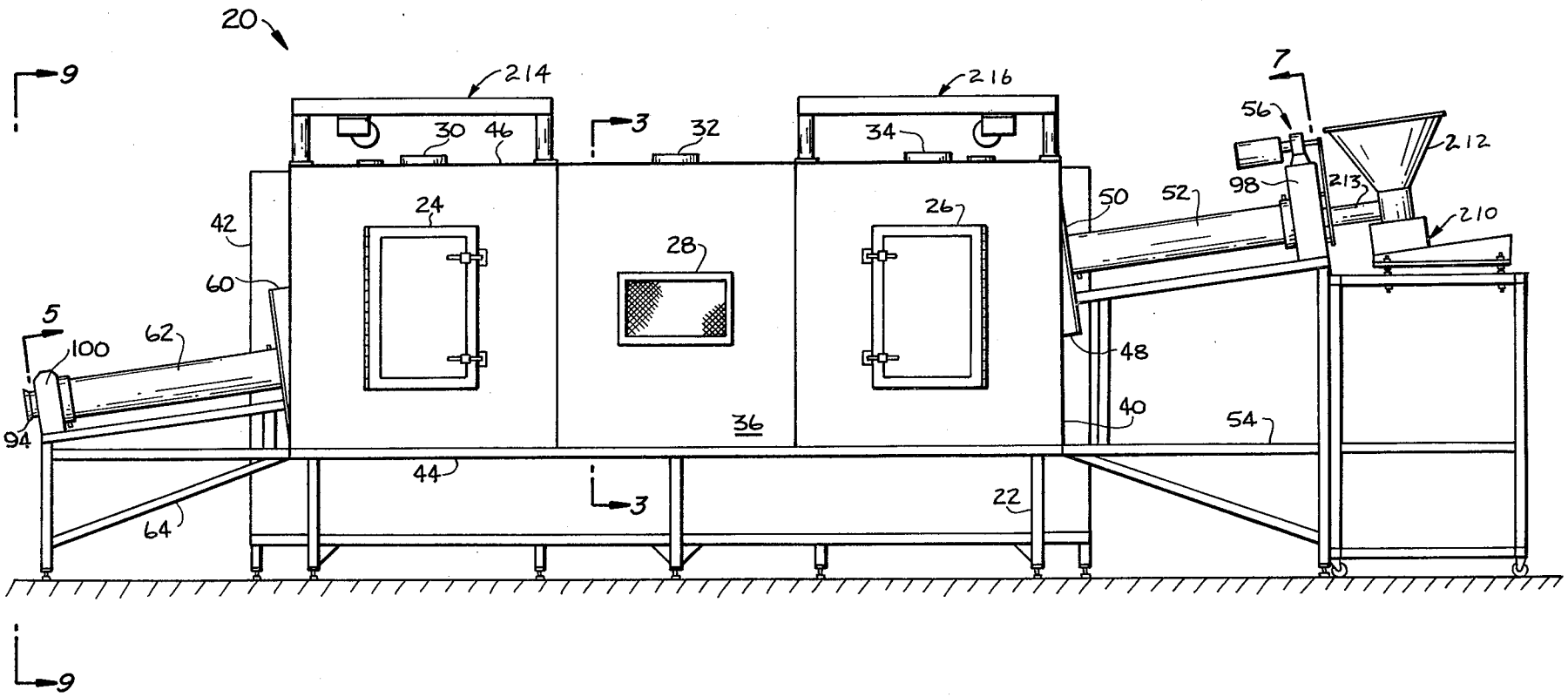
FIG. 1 is a side-elevational view of microwave heating apparatus constructed in accordance with the present invention.

Referring now particularly to the drawings, a preferred embodiment of the invention is shown which has been particularly designed and adapted for the processing of particulate rubber scrap. Such scrap exists as a by-product of the production of rubber goods such as rubber hosing, belting, tires and the like. Such scrap, if at least partially devulcanized, may be reintroduced together with an appropriate amount of raw rubber feed material into input feed stream of rubber goods production plants where it is blended and intermixed with the incoming feed and is found capable of reextrusion to produce acceptable rubber product. Such scrap, when ground into a relatively flowable material comprising particles of an average size of approximately ⅛ inch, can be at least partially devulcanized by the application of microwave fields in accordance with the present invention so as to raise its temperature to approximately 600° to 720° F. for a sufficient period.

GENERAL ARRANGEMENT

Referring now particularly to FIGS. 1, 2, 3 and 9 the apparatus for microwave treatment of flowable material in accordance with the present invention as shown and consists generally of a microwave oven 20 defining a microwave oven 20 defining a microwave cavity therein, the entire assembly being supported on a suitable microwave oven support framework 22. The microwave oven is provided with access doors 24 and 26, a vent-view window 28 and cavity vent ports 30, 32 and 34. The microwave oven is further defined by a front wall 36, a back wall 38, inlet end wall 40, outlet end wall 42 as well as bottom and top walls 44, 46 all of which are conductive. At the inlet side of the cavity, the inlet end wall 40 contains an inlet end load frame 48 which is canted at an upward angle for receiving the associated flange 50 of an inlet end load 52 at that side, the latter being supported on a suitable support framework 54 and tube drive assembly 56. A material feed and support assembly 58 is positioned adjacent the inlet end and delivers material to the apparatus through the drive assembly 56.

The outlet end wall 42 contains an outlet end load frame 60 which is angled downwardly and in alignment with the input end load frame 50. An outlet end load 62 is supported on a suitable framework 64 at the outlet end and is connected to the end load frame 60.

Each of the end loads 52 and 62 are of a type shown and described in detail in U.S. Pat. No. 3,983,956 taken out in the name of Peter D. Jurgensen for End-Load For Microwave Ovens and issued to the same assignee as the present application, referenced patent which is incorporated herein by reference for such construction. Accordingly, the end loads are indicated only in block diagram form in the sectional views given in FIGS. 6 and 8.

Figure 3:
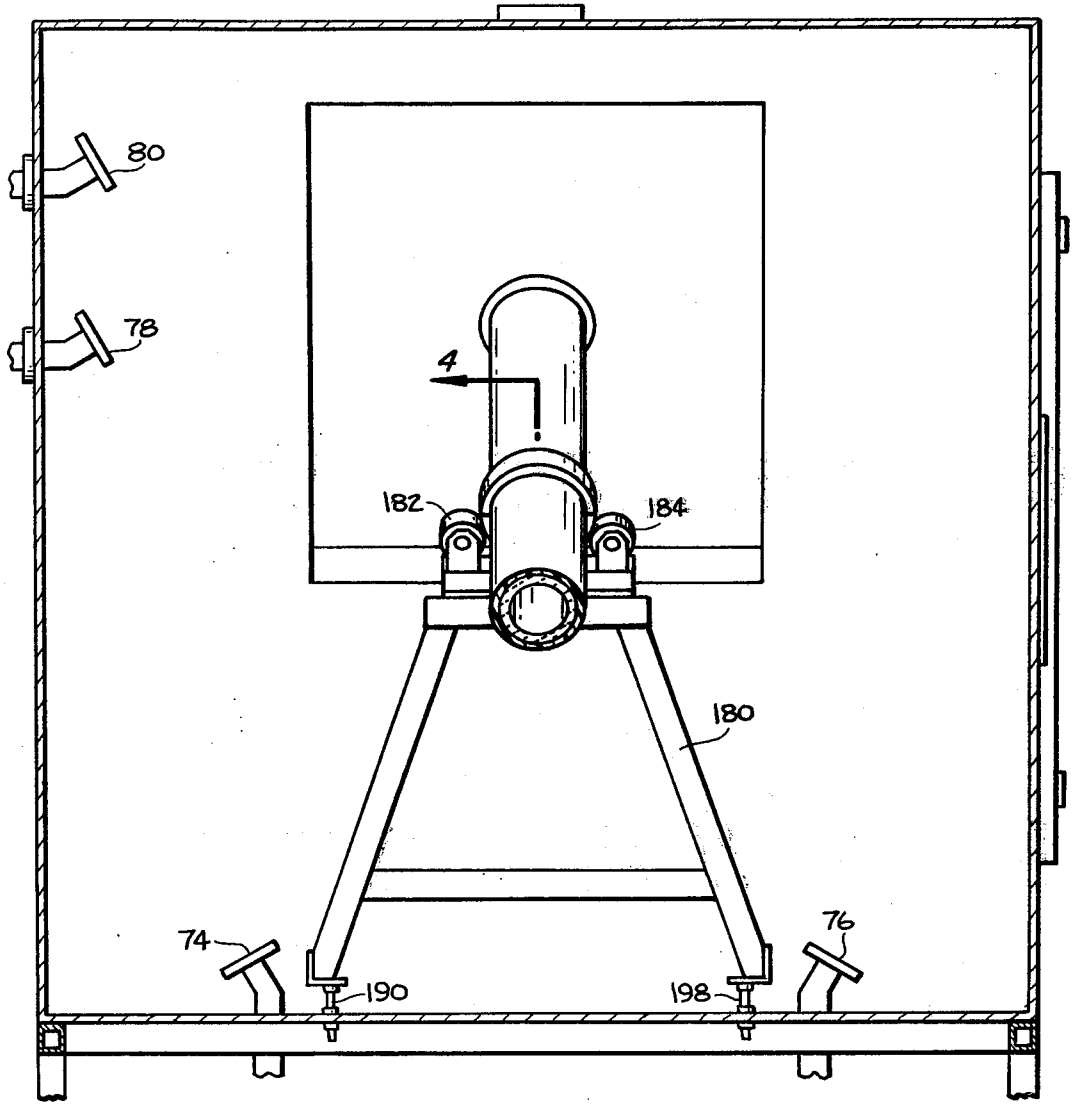
FIG. 3 is a cross-sectional view taken along the lines 3—3 of FIG. 1.
Figure 9:
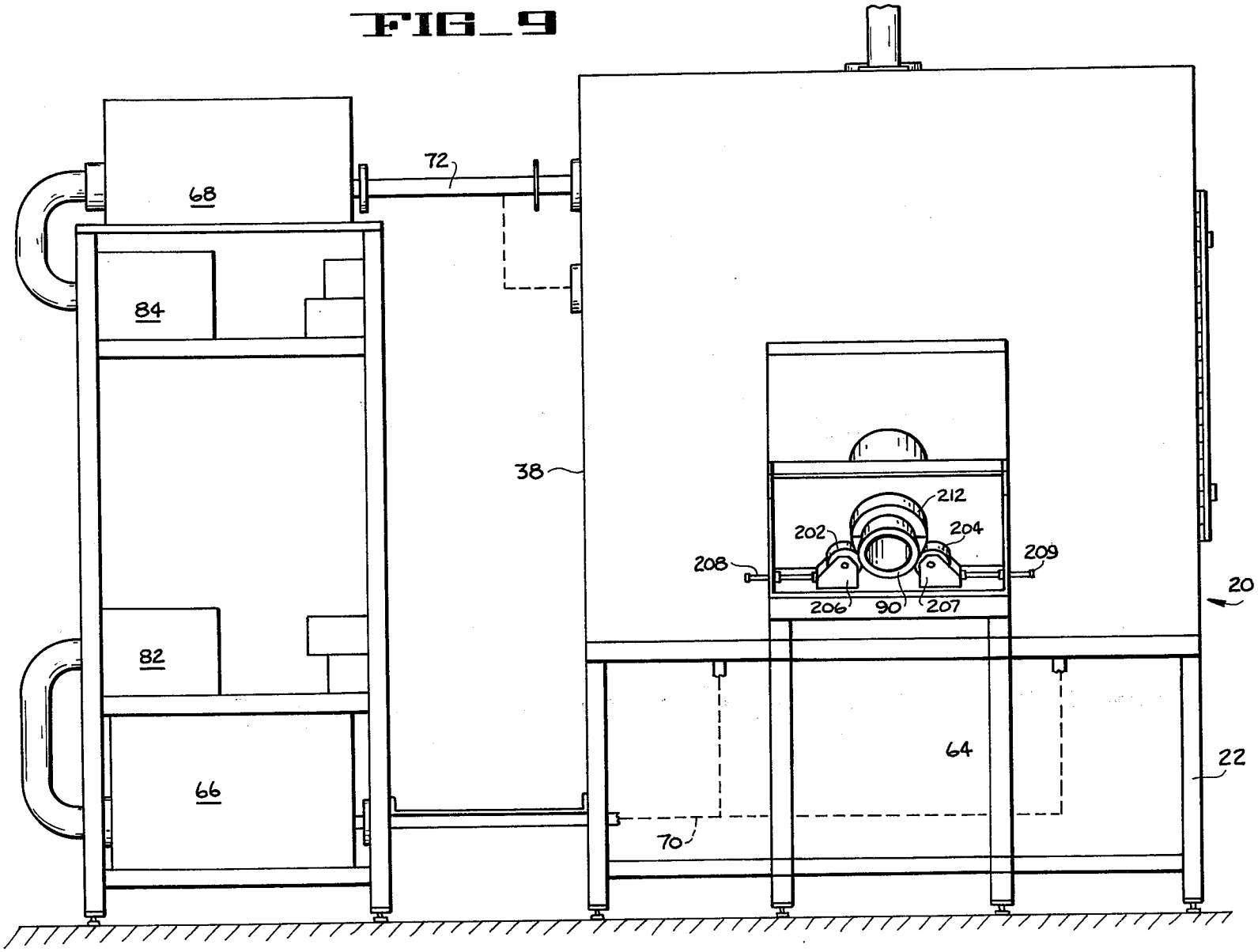
FIG. 9 is an end view taken from the lines 9—9 of FIG. 1.

As shown more fully in FIGS. 3 and 9 suitable power supplies 66 and 68 are connected through microwave power transmission tubing 70, 72 to power inlet ports 74, 76 and 78, 80 formed through the cavity walls. The construction of such ports is known and is set forth for example in the U.S. Pat. No. 3,916,137 taken out in the name of Peter Jurgensen and assigned to the same assignee as the present application. The power supplies are cooled in the usual manner by forced air from upper and lower pressurized air plenums 82, 84.

Figure 2:
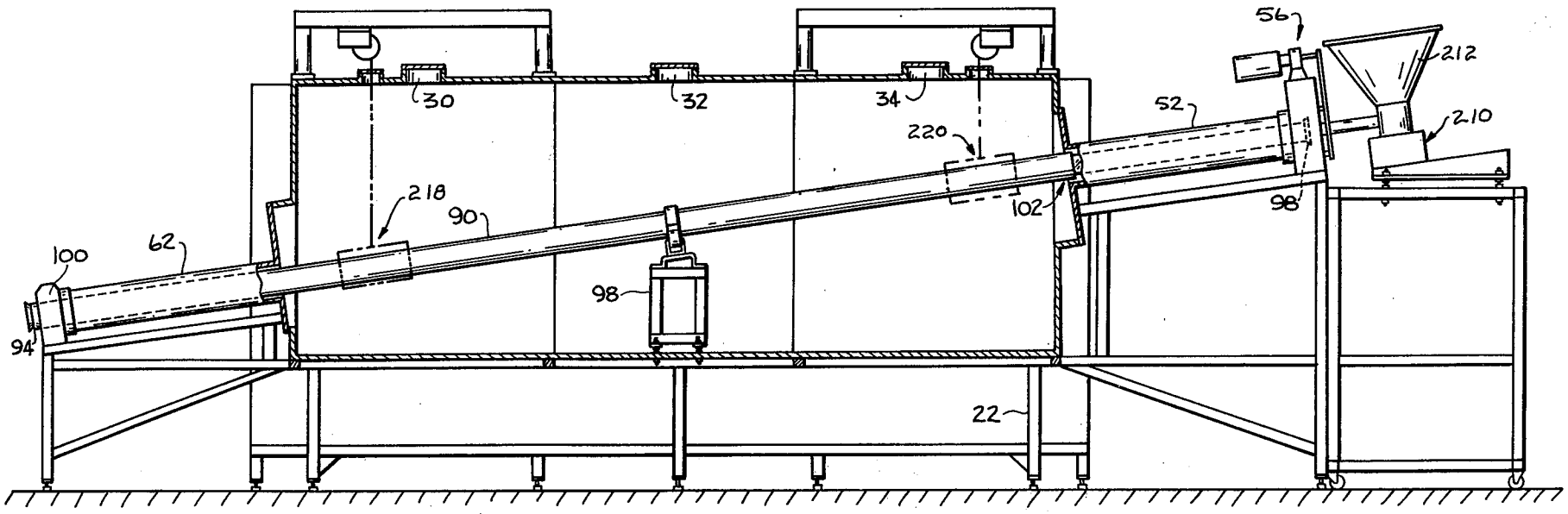
FIG. 2 is a view, partly in cross-section and similar to that of FIG. 1, showing the internal structure of the central portion of the microwave heating apparatus of FIG. 1 in greater internal detail.

As shown particularly in FIGS. 2 and 3, a closed cylindrical microwave transparent tube 90 is disposed in said cavity at a predetermined angle to the horizontal. Such tube consists, for example, of a heat resistant glass such as Pyrex brand glassware. The tube is formed into a one-piece unitary structure, circularly cylindrical in cross-section and extends continuously through said oven and end load from the outer extremities of end load inlet at 92 to outlet end load termination at 94.

Means are provided at the outer extremity of each end load assembly and at a position intermediate the length of the tube for supporting the same for rotation within the cavity while maintaining the tube's position therein against endwise movement. Such means consists of an inlet support 96 associated with the tube drive assembly, an intermediate support 98, and an outlet end support 100. The tube is insulated along its length from its entry into the oven at 102 to the outlet end 94 by wrapping the same in a suitable insulating material 104 which is microwave transparent and capable of withstanding the temperature of operation of the apparatus. One such suitable insulation for use in the specific embodiment shown is Cera-blanket (trademark) insulation sold by Johns Manville.

INLET SUPPORT AND DRIVE ASSEMBLY

Figure 7:
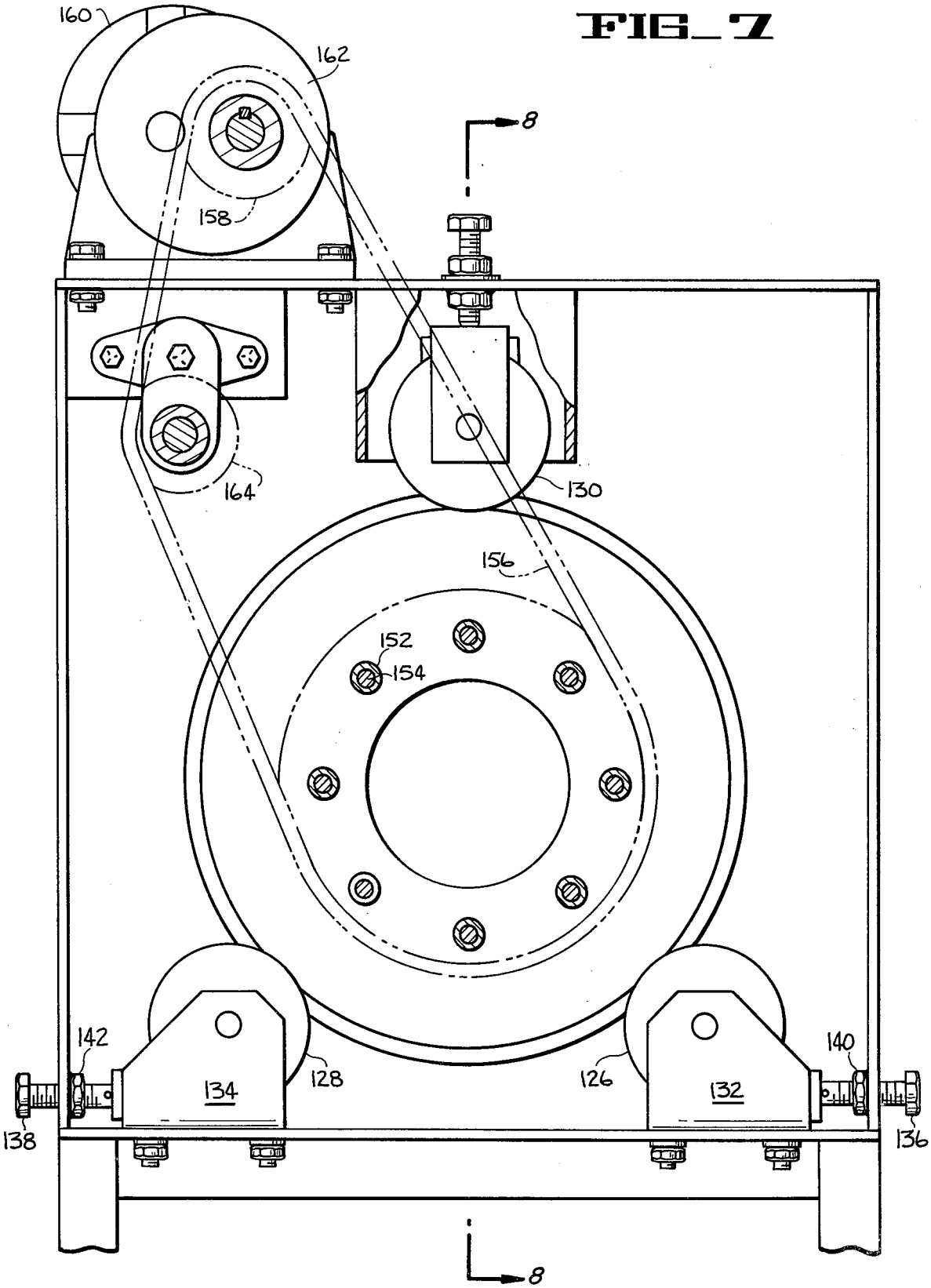
FIG. 7 is a sectional view taken along the line 7 of FIG. 1.
Figure 8:
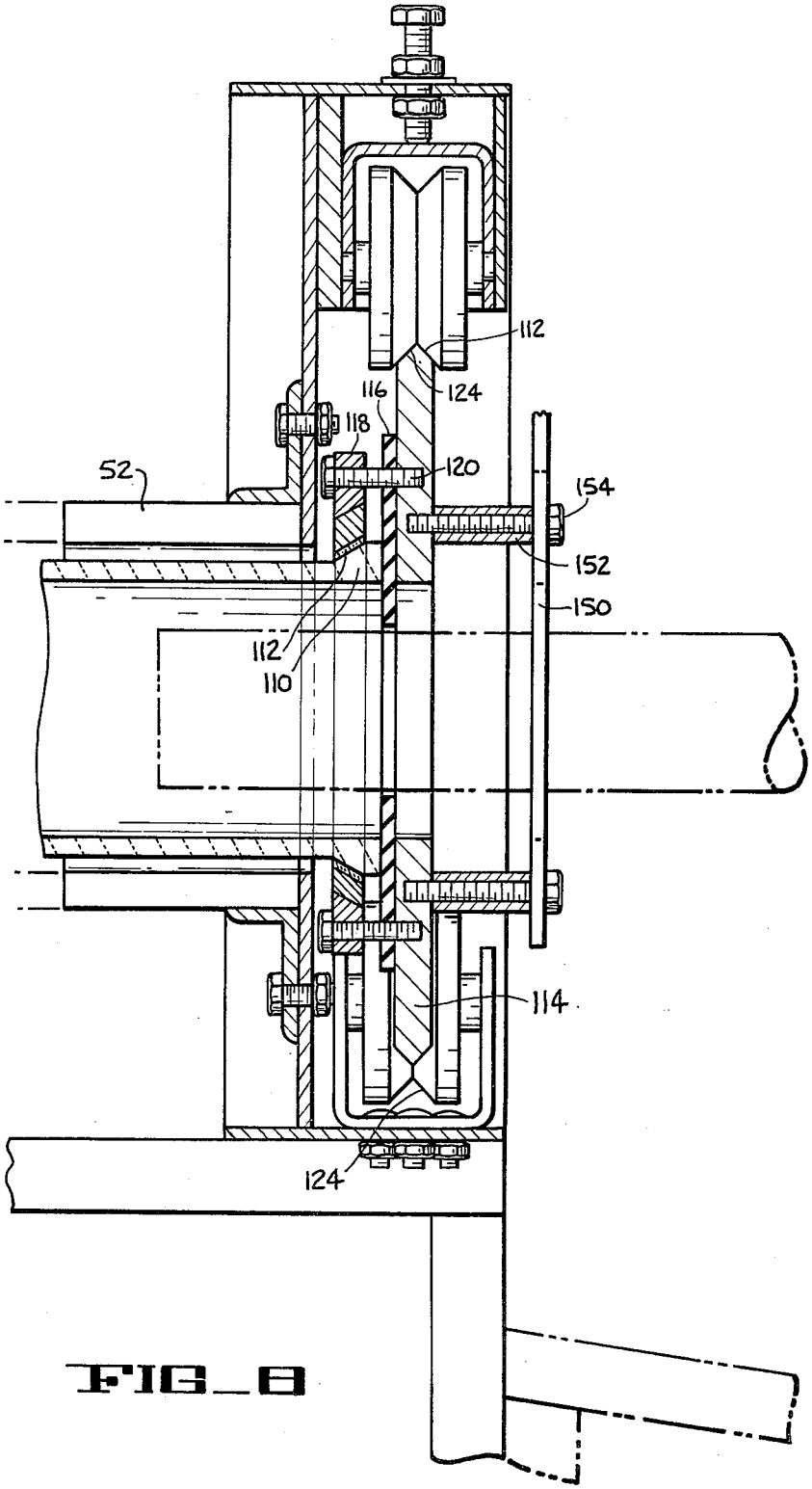
FIG. 8 is a cross-sectional view taken along the lines 8—8 of FIG. 7.

Referring now to FIGS. 7 and 8 there is shown in detail the drive assembly 56 for rotating the tube and for supporting the same at the inlet end. Tube 90 is conventionally terminated in an enlarged flange 110 at its end which is engaged from the tube side by an asbestos gasket 112. The outer side of the tube end is abutted by a tube support flange 114 and an interposed neoprene gasket 116 which are held in place in non-rotatable relation to the end of the tube by a clamping ring 118 attached to the flange by a plurality of suitable screws 120. The outer rim of flange 114 is provide with a v-shaped circumferential bevel 122 which faces radially outwardly and which is adapted to be engaged and supported within a mating v-shaped circumferential recess 124 in each of spaced apart tube support rollers 126, 128, 130. The lower tube support rollers 126, 128 are mounted in suitable roller brackets 132, 134 attached to the support framework 135, which are adapted for movement toward or away from each other by rotating adjustment of related bolts 136, 138 carried in support nuts 140, 142 mounted to the framework so that the height and lateral positioning of the tube as supported in the flange can be accurately and exactly controlled or adjusted. The upper support roller 130 is mounted in an upper roller bracket 144, upward movement being the elevation limited by upper bracket adjust belt 146. A drive gear 150 is mounted outwardly of the support flange on stand offs 152 by suitable bolts 154 the drive gear having outwardly facing teeth adapted to be engaged by a flexible sprocket chain 156 reaved about a motor drive pulley 158 to which a motor 160 is connected by suitable gearing 162. Tension and slack in the sprocket chain 156 are controlled by a spring loaded idler sprocket 164 mounted to frame 135.

The foregoing arrangement provides for three point lateral positioning and support of the tube and simultaneously supports the tube against axially directed end thrust load, as taken between the beveled rim of support flange and the recesses of each of the rollers 126, 128, 130.

INTERMEDIATE TUBE SUPPORT

Figure 4:
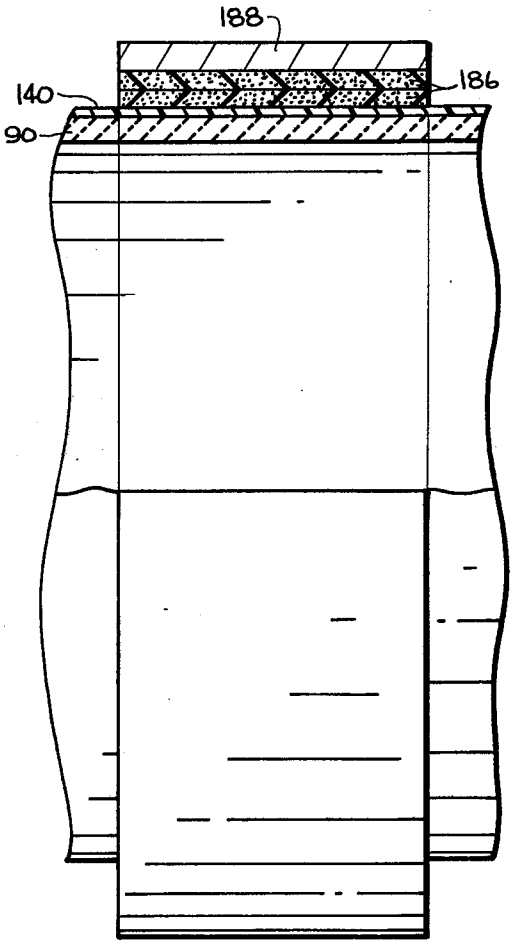
FIG. 4 is a cross-sectional view taken along line 4 of FIG. 3.

Referring now particularly to FIGS. 3 and 4 there is shown intermediate tube support 98 located within the microwave cavity consisting of a steady rest frame 180 having mounted thereon at its upper end a pair of spaced apart rollers 182, 184 canted upwardly at the same angle of inclination as tube 90. As shown particularly in FIG. 4 the tube 90 and associated thermal insulation are surrounded at the steady rest position by a sponge rubber gasket 186 about which is clamped a steady rest split bearing collar 188, the collar resting on rollers 182, 184. Elevation of support 98 is controlled by adjustable foot bolts 190, 198 connected between the legs of frame 180 and the floor of the microwave oven.

OUTLET END SUPPORT

Figure 6:
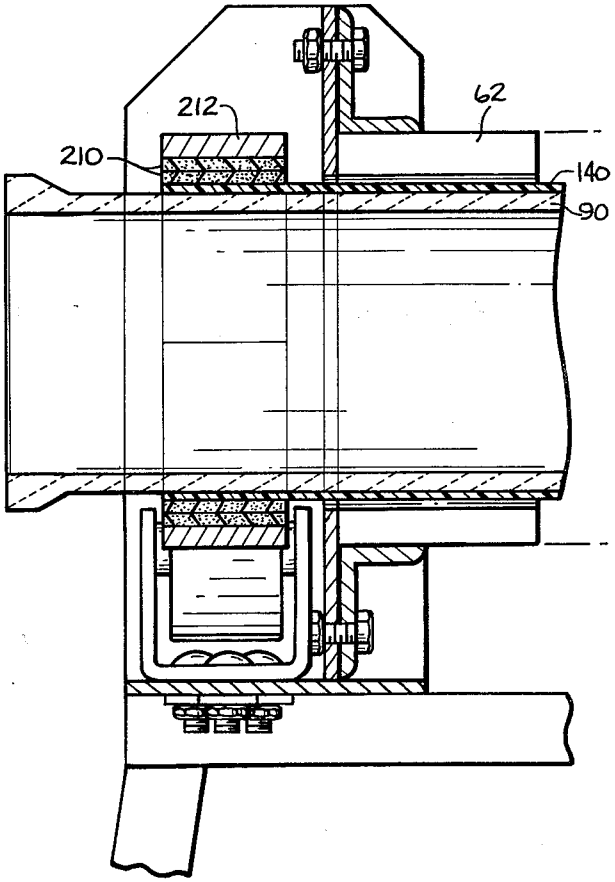
FIG. 6 is a cross-sectional view taken along the lines 6—6 of FIG. 5.
Figure 5:
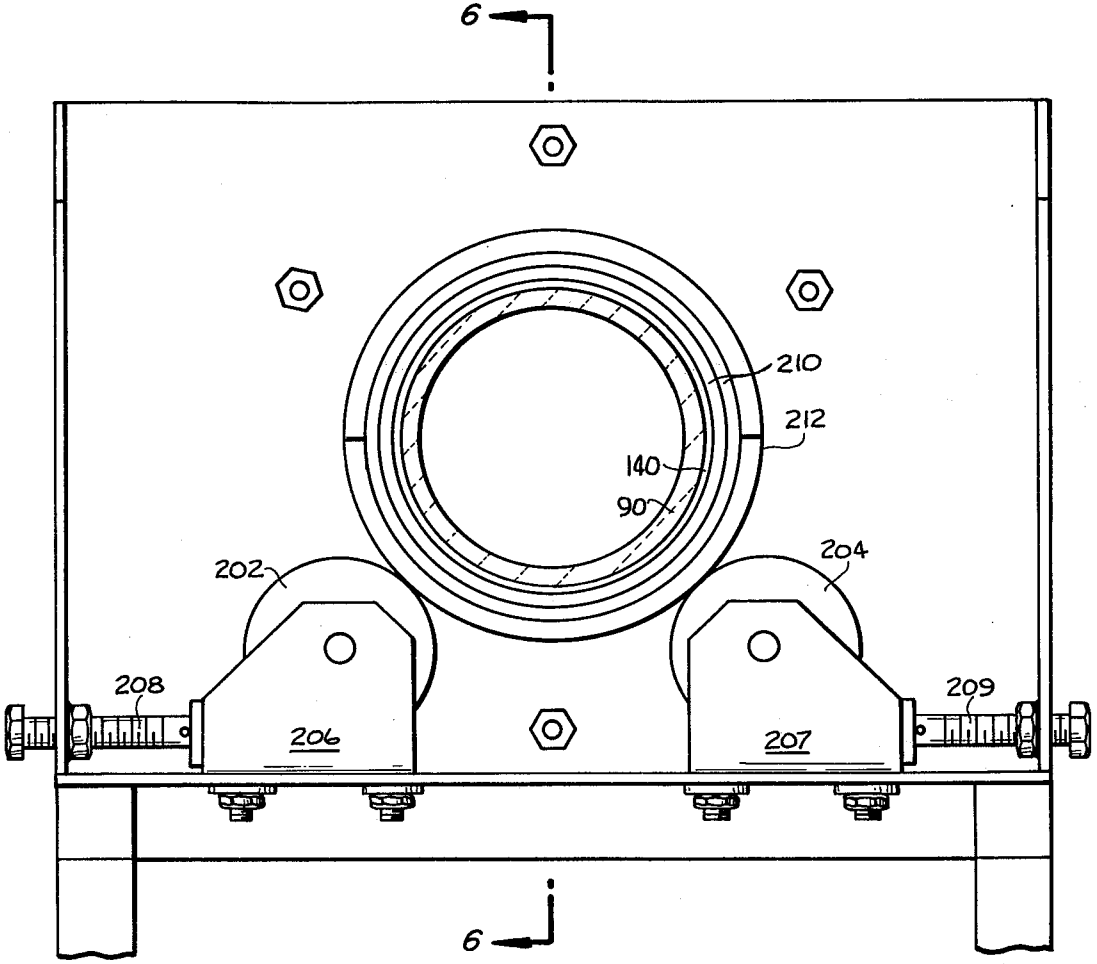
FIG. 5 is a cross-sectional view taken along the line 5 of FIG. 1.

Referring now to FIGS. 5 and 6 the output end load terminates and is supported in a frame 200 mounted to the end load support framework 64. Frame 200 carries a pair of spaced apart rollers 202, 204 angled upwardly in the same manner as previously described in connection with the intermediate support steady rest 180 and carried on roller brackets 206, 207 adjustably movable inwardly and outwardly by rotation of adjustment bolts 208, 209 carried through nuts mounted on the frame 200 so as to provide for an alignment of the several parts and for precise positioning and support of the tube assembly. The tube at the outlet end is surrounded by a sponge rubber gasket 210 and a split bearing collar 212 which rests on rollers 202, 204.

Input feed to the microwave treatment apparatus of the present invention is obtained by utilization of a conventional screw feed mechanism 210 at the lower end of a vibratory mounted hopper 212, the feed being passed through an inlet tube which passes in close proximity within the inner diameter opening of neoprene gasket 116 as shown in FIG. 8.

For the purpose of assembly there are provided a pair of gantries over each end of the microwave oven to which are attached removable frames 214, 216 for carrying cables to which slings 218, 220 are attached in the manner shown in FIG. 2. The slings attached to and support the product tube within the chamber prior to the fitting and adjustment of the various rotatary support elements at the termination of the end loads and at the intermediate support. In this way the tube is roughly positioned and supported while the precise alignment of the supporting means is obtained, after which the slings are removed and the opening capped with conductive plate.

The following are typical dimensions for a preferred embodiment of the present invention useful for the devulcanization of rubber scrap by application of microwave energy at a frequency of 2450 megahertz and are given to facilitate understanding of the invention. Microwave product tube length approximately 24 feet: tube diameter 6 inches; end load length at each end load, approximately 5 feet; microwave oven (end to end) length approximately 15 feet, speed of operation approximately 8 to 20 revolutions per minute, angle of inclination of product tube 8°, preferred speed of rotation 12–14 revolutions per minute, product through-put capacity 900 pounds per hour.

In the performance of the present invention it will be noted that the elongated product tube presents a smooth interior bore inclined at the preferred angle to the horizontal. The product material when introduced through the input feed tube falls into the inlet of the bore and proceeds downwardly through the bore in a manner suggesting partial filling of the bore the product being rotated as it passes downwardly in such a way that it rolls up the side wall of the tube and in so doing also progresses downwardly as though at the pitch angle 8°, equal to angle of inclination defined by the tube. As the product rolls up the tube wall and downwardly it eventually reaches a point of relative nonsupport and falls in a free flowing rain of material downwardly cascading to the lower portion at the lower side of the tube and at a position located at the product of pitch angle and rotation a progressive distance down the tube axis. In this way the tube behaves something as a helical conveyor having an effective forward/downward drive equal to the pitch angle rotation product. The combination of the climb of the material up the tube wall due to rotation together with the fall of the material from a position upward of the tube downwardly which is a function of the angle of inclination can be defined by simple triangular relationship as the advancement of the product down the tube.

While the angle selected and the speed of rotation given relate to the processing of a particular material the form of approximately ⅛ inch particulate rubber scrap and having a density equivalent thereto it will be appreciated that other pitch angles and speeds of rotation will be appropriate to different materials which it may be desired to process. The general criteria for any product material can be easily derived by measurement in such small apparatus on an experimental basis the scale up of which is straight forward.

As shown the product tube is insulated from a position adjacent the inlet end of the cavity completely through the output end load. The reasoning for this is that there is no need for insulation prior to entry to the cavity where microwave heating occurs. After entry to the cavity it is desired to contain all heat generated within the tube for use in the heating of the product being processed. And, subsequent to emergence from the microwave oven it is additionally desired to maintain the product at an elevated temperature without cooling since the degree of devulcanization is a function also of the residence time at a elevated temperature as well as the maximum temperature achieved. In that connection the additional thermal insulation extending through the outlet inload isolates the cool end load from the hot product being discharged and permits the product to be held at a significant high temperature residence time even within the end load. The residence time may be further increased by heated processing equipment following the output of the present invention.

In the preferred embodiment disclosed herein it has been stated that it is useful for devulcanization of rubber utilizing a frequency of 2450 megahertz. While this may seem to be an arbitrary choice of frequencies, it is one of the commercially available microwave heating frequencies in the United States. In addition, it should be pointed out that tests with samples showed a change in conductivity at room temperature of several hundred thousand ohms per square to a conductivity of only ten ohms per square in the temperatures in excess of 400° F. This run-away loss factor is aggrevated at 915 megahertz, and other available frequencies. Curves relating the loss factors and the changes as a function of heating for these two commercially available frequencies have been computed and 2450 megahertz has been found preferable.

Thus there has been disclosed a system method and apparatus for microwave treatment of material in a continuous manner through a microwave cavity which has several unique advantages. The present invention handles particulate material at very high temperatures and permits the control of the atmosphere in which the particulate material is being treated. The smooth interior bore of the elongate glass product tube, provides a unique transport mechanism for handling particulate materials which is simple and elegant to operate from entirely without the oven and which further provides continuous form of intermixing and agitation of the particles. In application to the heating of rubber particles as disclosed herein it is found that isolated heating of rubber particles is avoided since each rubber particle even though continuously agitated, maintains a degree of residence time in contact with other rubber particles as it proceeds through each portion of a turn of the tube. This results in thermal exchange with other particles which eliminates hot spots formerly resulting in thermal run away and spontaneous combustion. In addition, the utilization of a glass tube completely enclosing the material in the manner disclosed permits the handling of particulate materials in the range, for example, of 600° to 720° F and possibly higher for which there are few if any other transportation systems capable of operation. In applications where the material being processed gives off noxious fumes when heated the present system provides for complete control of such fumes. In addition, the gas contained within the product tube may be controlled and even oxygen starved if desired.

While the disclosures herein have been particularly directed to the use of a horizontally disposed microwave oven having an inclined tube passing therethrough and through its end walls it should be realized that other structural arrangements will be found suitable to those skilled in the art for carrying out the present invention. For example, the product tube may be mounted in a particular desired orientation with respect to the microwave cavity arrangement, the entire assembly being tilted to a suitable angle for operation of the tube. In addition, obvious adjustment of the tube angle of inclination can be made by additional inclination of the floor on which the entire apparatus is mounted either by suitable jacks or other means.

It should further be pointed out that selections of materials made herein have been designated for the particular purpose of the preferred embodiment described, but that such selection of materials may well be different but evident to those skilled in the art in seeking to apply the invention to other applications. Thus, for example, while Pyrex brand glassware is found suitable for devulcanization of rubber particles at elevated temperatures as disclosed herein, such glassware may not be suitable for the handling of other materials. In that connection quartz which possess many of the same desirable properties as glass in this application but which is even more resistant to thermal stress at high temperatures may well be found suitable for use in many other applications.

Other applications of the present invention are invisioned in which the same can be used in the microwave drying or other processing of pharmaceuticals, particularly pharmaceutical powders. It is a particular advantage of the present invention in such applications that a completely isolated environment can be established through which the product passes while undergoing treatment. Thus, assuring maintenance of pharmaceutical purity conditions as may be required. In addition, where control of the atmosphere through which the product passes is desired for reaction purposes as in the reaction of a gas with a solid, the present invention provides a completely enclosed system for treating such solids in counter-flow or other relation with a gas at elevated temperatures to obtain the desired reaction. In the foregoing applications it is evident that both the particulate matter being treated and the atmosphere in which the treatment occurs all are contained within a single rotating product tube element passing through the microwave oven. Furthermore, as disclosed herein access to the tube is conveniently obtained from without the oven so as to faciliate detachment and employment of conventional apparatus without need for concern of the microwave field configuration within the cavity of the oven itself. Thus, many manifestations and adaptations of the invention will occur to those skilled in the art to which it pertains, and accordingly, the scope of the invention should not be taken as limited by the specific disclosure of preferred embodiment herein but should be taken in consideration of the scope of the disclosures contained herein in conjunction with the appended claims.

What is claimed is:

1. In a method for heating flowable material in a microwave oven having a microwave transparent tube extending therethrough, the steps of rotating said tube, said tube being inclined at an angle to the horizontal such that the material will flow through the tube as the tube is rotated, feeding material into the upper end of said tube, and removing material having passed through said tube from its lower end.

2. A method for heating flowable material as in claim 1 in which the angle of inclination of said tube and the speed of rotation thereof, are adjusted such that said material is maintained in constant agitation while being progressively moved through said tube from its upper to lower end.

3. A method as in claim 1 in which the angle of inclination of said tube for a given range of rotation speed is large enough to prevent build-up of load material from filling the tube cross-section, but less than that in which the material falls through the tube without mixing.

4. A method as in claim 1 further including the step of insulating said tube throughout a portion of its length in said cavity to lessen the escape of heat therefrom.

5. A method as in claim 1 in which the angle of inclination of said tube is selected from about 5° to 11° to the horizontal and in which said speed of rotation is selected from the range of approximately 8 to 20 revolutions per minute.

6. A method as in claim 1 in which the flowable material is in particulate form and the angle of inclination of said tube for a given range of rotation speeds is large enough to prevent a build-up of particles from filling said tube cross-section, but less than that in which the particles fall through said tube without mixing, so that said particles collect and accumulate over a partial cross-section of the tube and fall off the upper side of said collected cross-section in continuous mixing action as the same progress through said tube.

7. A method as in claim 6 in which said angle of inclination of said tube is selected from about 5° to 11° to the horizontal and in which said speed of rotation is selected from the range of approximately 8 to 20 revolutions per minute.

8. A method as in claim 1 in which the flowable material comprises rubber particles on the order of ⅛ inch – ¼ inch in size, the angle of inclination of said tube is selected to be approximately 8°, and the speed of rotation is selected approximately in the range of 12 to 14 revolutions per minute.

9. A method as in claim 1 in which said microwave energy is supplied at a frequency of about 2450 megahertz.

10. In apparatus for heating flowable material, a microwave oven having a cavity therein, means for supplying microwave power to said cavity, means forming a cylindrical tube transparent to microwave energy in said cavity at a predetermined angle to the horizontal therein, means for supporting said tube for rotation in said cavity, means for rotating said tube, means for delivering material to the upper end of said tube and means for removing material having passed through said tube from its lower end.

11. Apparatus as in claim 10 wherein said oven has outer walls through which said tube extends, together with end-loads surrounding the portion of said tube extending beyond the outer walls for minimizing leakage of microwave radiation from said oven.

12. Apparatus as in claim 10 further including insulating material surrounding said tube along a predetermined length thereof within said oven.

13. Apparatus as in claim 10 wherein said means for supporting said tube and for rotating said tube are located externally of said microwave oven.

14. Apparatus as in claim 11 in which said tube is circularly cylindrical and the end-loads have a circularly cylindrical bore extending therethrough for permitting passage of said tube.

15. Apparatus as in claim 10 further including means for supporting said tube internally of said oven at a position intermediate its length therein.

16. Apparatus as in claim 10 in which the angle of inclination of said tube and the speed of rotation of said tube are such that the material passing through the tube is maintained in constant agitation while being progressively moved downwardly through said tube.

17. In a method for heating flowable material by microwave energy in an oven having a microwave transparent tube therein inclined at an angle to the horizontal such that said material will flow through the tube as the tube is rotated, the steps of: rotating said tube, feeding the material into the upper end of said tube, removing the material having passed through said tube from the lower end of the tube, and passing microwave energy through the cylindrical side wall of the tube to the material passing through the tube to effect heating of said material.

* * * * *